US010327485B2

(12) United States Patent
Jones et al.

(10) Patent No.: US 10,327,485 B2
(45) Date of Patent: Jun. 25, 2019

(54) FLEXIBLE SUPPORTED GLOVE STRUCTURES

(71) Applicant: NIKE, Inc., Beaverton, OR (US)

(72) Inventors: Michael Jones, Beaverton, OR (US); Darien Curl, Beaverton, OR (US); Marci Duchene, Beaverton, OR (US); Carl L. Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 144 days.

(21) Appl. No.: 15/377,506

(22) Filed: Dec. 13, 2016

(65) Prior Publication Data

US 2017/0086517 A1 Mar. 30, 2017

Related U.S. Application Data

(62) Division of application No. 13/440,943, filed on Apr. 5, 2012, now Pat. No. 9,538,797.

(51) Int. Cl.
*A41D 19/00* (2006.01)
*A63B 71/14* (2006.01)
(Continued)

(52) U.S. Cl.
CPC ..... *A41D 19/0017* (2013.01); *A41D 19/0013* (2013.01); *A41D 19/0048* (2013.01);
(Continued)

(58) Field of Classification Search
CPC ..... A41D 19/0013; A63B 71/141; A63B 2209/10; A63B 71/146
See application file for complete search history.

(56) References Cited

U.S. PATENT DOCUMENTS 889,397 A 6/1908 O'Shaughnessy
3,152,338 A 10/1964 Strauss
(Continued)

FOREIGN PATENT DOCUMENTS

CN 201157002 Y 12/2008

OTHER PUBLICATIONS

Sep. 5, 2013—(WO) International Search Report and Written Opinion issued in corresponding Internantional App PCT/US2013/035108.
(Continued)

*Primary Examiner* — Khaled Annis
(74) *Attorney, Agent, or Firm* — Banner & Witcoff, Ltd.

(57) ABSTRACT

Glove structures may include front and back portions. A knuckle support assembly may be attached to the back portion. The knuckle support assembly may include a knuckle support member having at least one cutout coincident with at least one metacarpophalangeal joint and a flexible member extending across the at least one cutout. The knuckle support member may have a greater flexural stiffness than the back portion. The material of the knuckle support member may be more elastically stretchable than the material of the back portion. The material of the flexible member may be more elastically stretchable than the material of the back portion. The knuckle support member may be molded to the flexible member. Alternatively, the knuckle support member and the flexible member may be fuse bonded to one another. Methods for making such glove structures are also provided.

17 Claims, 7 Drawing Sheets

(51) Int. Cl.
*A41D 27/28* (2006.01)
*A41F 1/06* (2006.01)

(52) U.S. Cl.
CPC ..... *A41D 27/28* (2013.01); *A41F 1/06* (2013.01); *A63B 71/141* (2013.01); *A63B 71/146* (2013.01); *A63B 71/148* (2013.01); *A41D 2600/10* (2013.01); *A41D 2600/20* (2013.01); *A63B 2209/10* (2013.01)

(56) References Cited

U.S. PATENT DOCUMENTS

| | | | |
|---|---|---|---|
| 3,997,922 | A | 12/1976 | Huhta |
| 4,164,043 | A | 8/1979 | Fujita |
| 4,525,877 | A | 7/1985 | Chong |
| 4,561,122 | A | 12/1985 | Stanley et al. |
| 5,708,979 | A | 1/1998 | Redwood et al. |
| 5,815,839 | A | 10/1998 | Safford |
| 5,867,830 | A | 2/1999 | Chen |
| 5,893,172 | A | 4/1999 | Haynes et al. |
| 6,279,166 | B1 | 8/2001 | Schild |
| 6,415,445 | B1 | 7/2002 | Nishijima et al. |
| 6,427,247 | B1 | 8/2002 | Suk |
| 6,543,058 | B2 | 4/2003 | Litke |
| 6,625,815 | B2 | 9/2003 | Litke |
| 6,651,255 | B1 | 11/2003 | Schild |
| 6,944,884 | B1 | 9/2005 | Sokolowski |
| 6,964,063 | B2 | 11/2005 | Bamber |
| D549,398 | S | 8/2007 | Swartz et al. |
| D583,509 | S | 12/2008 | Widdemer |
| 7,694,352 | B2 | 4/2010 | Kogawa et al. |
| 7,707,653 | B2 | 5/2010 | Kleinert |
| 7,895,669 | B2 | 3/2011 | Kleinert |
| 7,895,670 | B2 * | 3/2011 | Kleinert ..... A41D 19/01582 2/161.1 |
| 2002/0042940 | A1 | 4/2002 | Kuroda et al. |
| 2003/0005507 | A1 | 1/2003 | Litke |
| 2005/0034213 | A1 | 2/2005 | Bamber |
| 2006/0212990 | A1 | 9/2006 | Mattesky |
| 2007/0245455 | A1 | 10/2007 | Robba |
| 2008/0000009 | A1 | 1/2008 | Kogawa et al. |
| 2008/0072358 | A1 | 3/2008 | Kleinert |
| 2008/0109934 | A1 | 5/2008 | Widdemer et al. |
| 2009/0077714 | A1 | 3/2009 | Baacke |
| 2010/0186142 | A1 | 7/2010 | Kume et al. |
| 2011/0296582 | A1 | 12/2011 | Bevier et al. |
| 2012/0005805 | A1 | 1/2012 | Bevier et al. |
| 2012/0030856 | A1 | 2/2012 | Bevier |
| 2013/0061369 | A1 | 3/2013 | Lim |
| 2013/0263354 | A1 | 10/2013 | Gibby |
| 2013/0276207 | A1 | 10/2013 | Curl et al. |

OTHER PUBLICATIONS

Oct. 7, 2014—(WO) International Preliminary Report on Patentability issued in corresponding Internantional App PCT/US2013/035108.

* cited by examiner

FLEXIBLE SUPPORTED GLOVE STRUCTURES

CROSS-REFERENCE TO RELATED APPLICATIONS

This Application is a Divisional of U.S. application Ser. No. 13/440,943, filed Apr. 5, 2012, which is incorporated by reference in its entirety.

FIELD OF THE INVENTION

The present invention relates to the field of gloves structures. In some examples, aspects of the present invention pertain to athletic gloves that are very flexible while still providing excellent support.

BACKGROUND

When participating in athletic activities (golfing, batting, etc.) and/or doing work (e.g., gardening, shoveling, sweeping, digging, etc.), people often wish to wear gloves to protect the hands and/or provide improved grip on the implement they are holding. Gloves for these activities, e.g., for use in golf, baseball, softball, football, weightlifting, and other sports and/or for use as work gloves, however, can be stiff and/or binding. This can make the gloves uncomfortable to wear and/or inhibit freedom of movement. Further, gloves that are too stiff may fail to fit properly, thereby failing to provide adequate support.

Additionally, some gloves are provided with one or more lines of stitching running straight across the back near or over the knuckle region. Examples include zig-zag elastic stitch lines that may cause bunching in the knuckle region. These stitch lines may be uncomfortable when the glove is stretched across the knuckle region, e.g., when the hands are flexed or clenched such as for gripping an implement.

Failure to wear properly fitted gloves can compromise grips, cause the hands to tire more easily, and risk irritating or injuring the skin. Accordingly, there is a need in the art for flexible gloves having excellent support while also providing adequate freedom of movement, breathability and comfort.

SUMMARY OF THE INVENTION

This Summary is provided to introduce some general concepts relating to this invention in a simplified form that are further described below in the Detailed Description. This Summary is not intended to identify key features or essential features of the invention.

Glove structures in accordance with at least some examples of this invention may include, for example, a front portion and a back portion. According to certain aspects, the back portion may include a back main section located opposite the front main section and a knuckle support assembly attached to the back main section. The knuckle support assembly may include a knuckle support member having at least one cutout coincident with at least one metacarpophalangeal joint and a flexible member extending across the at least one cutout. The knuckle support member may have a greater flexural stiffness than the back main section. The material of the knuckle support member may be more elastically stretchable than the material of the back main section. The material of the flexible member may be more elastically stretchable than the material of the back main section and/or the knuckle support member. Further, the knuckle support member and the flexible member may be molded or fuse bonded to one another to form a knuckle support assembly.

Methods for making such glove structures are also provided. According to certain aspects a method for forming a glove structure may include providing a knuckle support member having at least one cutout, providing a flexible member, wherein a material of the flexible member has a greater elastic stretchability than a material of the knuckle support member, and forming a knuckle support assembly by attaching the flexible member to the knuckle support member, wherein the flexible member extends across the at least one cutout. The method may also include attaching the knuckle support assembly to a back portion of the glove structure and aligning a first cutout of the at least one cutout with at least one metacarpophalangeal joint (e.g., at a location on the glove that will lie adjacent at least one metacarpophalangeal joint when a hand is inserted inside the glove).

According to some aspects, a method may include forming the knuckle support assembly by molding the knuckle support member onto the flexible member. Alternatively, the method may include forming the knuckle support assembly by fuse bonding at least portions of the flexible member to at least portions of the knuckle support member. According to other aspects, the method may include forming a wave-like seam to attach the knuckle support assembly to the back main section of the back portion.

According to further aspects, the method may include aligning a cutout with a location on the glove such that the frame of the cutout will lie adjacent the metacarpophalangeal joint of an index finger, aligning a cutout with a location on the glove such that the frame of the cutout will lie adjacent a proximal interphalangeal joint, and/or aligning a plurality of cutouts with locations on the glove such that the frames of the cutouts will lie adjacent the metacarpophalangeal joints of an index finger, a middle finger, a ring finger and/or a little finger.

According to even other aspects, a glove structure having a front portion including a front main section for covering the palm of a hand, a back portion engaged with the front portion for covering a back of the hand, and a closure system attached to at least one of the front portion and the back portion may be provided. The closure system may include a flap having an attached end, a free end, at least a first component of a fastening system positioned between the attached end and the free end, and a free end tab extending beyond the first component of the fastening system. The free end tab may include at least one tactile element, which may be a raised protrusion, for facilitating a user's grip. The fastening system may be a hook-and-loop fastener. The flap and the tactile element may be formed of silicone rubber.

The glove structure may further include a knuckle support assembly located at least partially in a metacarpophalangeal joint region of the back portion. The knuckle support assembly may include a knuckle support member having at least one cutout coincident with at least one metacarpophalangeal joint and a flexible member extending across the at least one cutout. The knuckle support member may have a greater flexural stiffness than the back portion. Further, the material of the knuckle support member may have a greater elastic stretchability than the material of the back portion. Similarly, the material of the flexible member may have a greater elastic stretchability than the material of the back portion.

Aspects of this invention relate to glove structures, and particularly to work or athletic gloves that are very lightweight and flexible while still providing adequate support and structure for their intended use. More specific features and aspects of this invention will be described in detail below.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

Figure 1A:
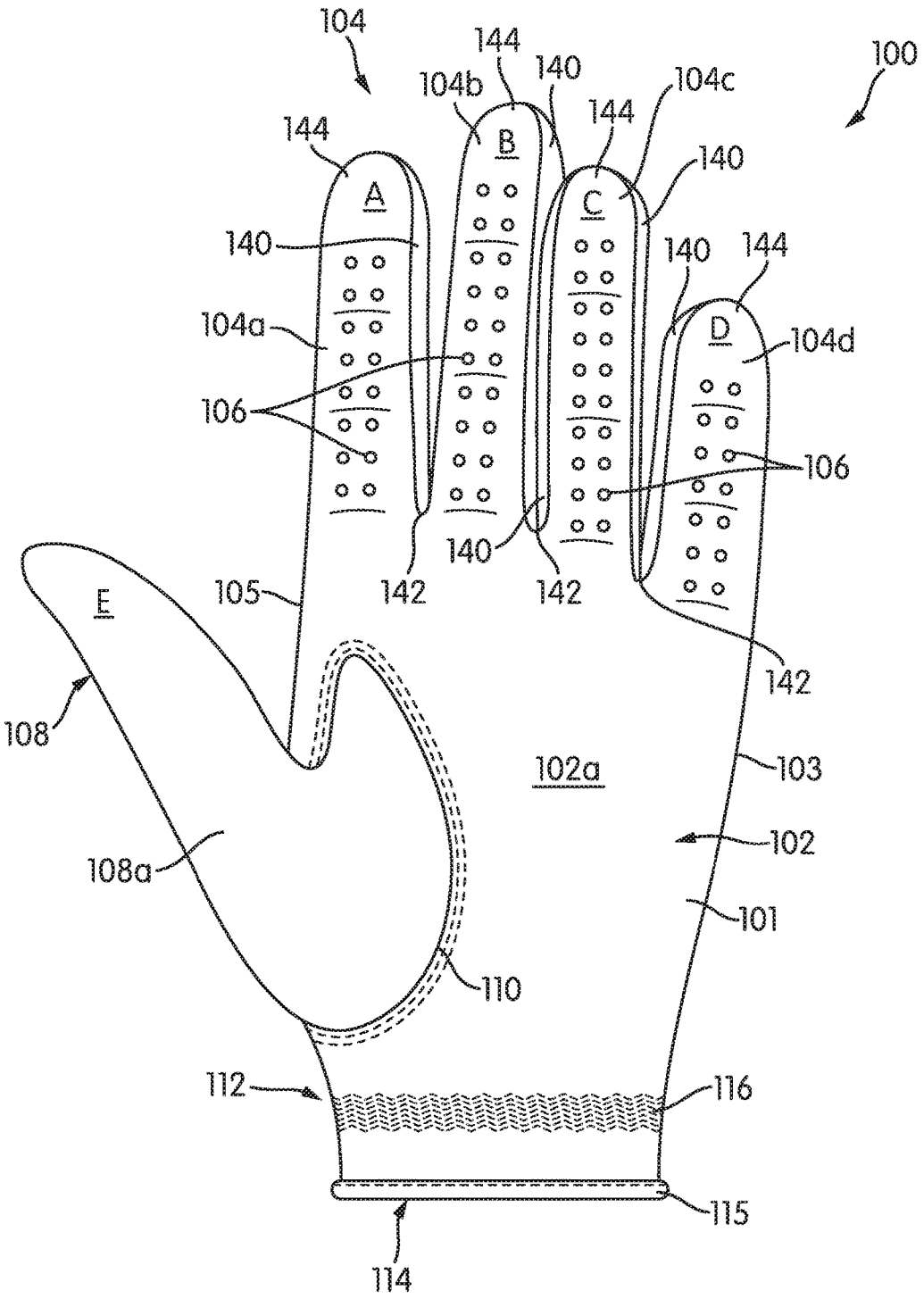
FIGS. 1A and 1B illustrate front and back views of one example glove structure in accordance with this invention.

The reader is advised that the attached drawings depict various example features and combinations of features of glove structures in accordance with examples of this invention. These drawings are not necessary drawn to scale.

DETAILED DESCRIPTION OF THE INVENTION

In the following description of various examples of gloves according to the present invention, reference is made to the accompanying drawings, which form a part hereof, and in which are shown by way of illustration various example athletic glove structures in which aspects of the invention may be included. It is to be understood that other glove structures for other uses may be provided and that structural and functional modifications may be made from the specifically described structures and methods without departing from the scope of the present invention.

Referring to the figures and following discussion, various gloves structures and features thereof in accordance with the present invention are disclosed. The gloves depicted and discussed are athletic gloves (and particularly golf gloves), and the concepts disclosed with respect to various aspects of these gloves may be applied to a wide range of athletic glove structures, including, but not limited to: golf gloves, batting gloves, football gloves, weightlifting gloves, and gloves for other sports. In addition, at least some concepts and aspects of the present invention may be applied to a wide range of non-athletic gloves, including gardening gloves, yard work gloves, cleaning gloves, work gloves, and gloves for other activities in which lightweight construction, support and breathability are desired while not sacrificing grip or protection of the hands. Even further, the concepts disclosed herein may be applied to other hand-receiving structures, for example, partial gloves, protective hand sheaths and/or manual and remote controllers. Accordingly, the present invention is not limited to the precise embodiments disclosed herein, but applies to glove and hand-receiving structures generally.

Certain regions of a glove or other hand-receiving structure or any portion thereof also may be described herein by reference to the anatomical structures of a human hand wearing a glove or other hand-receiving structure that is properly sized for that hand. Thus, a person skilled in the art will understand that a phrase like "aligning a cutout with the metacarpophalangeal joint" (or other joint) of a finger simply means that the cutout is positioned such that the opening of the cutout aligns with the noted joint of a hand that is properly sized for the glove (or other structure) when the hand is inserted into the glove (or other structure). Phrases of this type should not be construed as requiring a hand to be located within the glove or other structure.

Detailed Description of Example Glove Structures

According to certain aspects of the invention, glove structures as disclosed herein may provide improved support with increased flexibility and stretchability around a wearer's knuckle areas. According to certain embodiments, the improved support may be provided by a silicone rubber knuckle support member extending around and between at least some of a wearer's knuckles, while the increased flexibility may be provided by a stretchable textile material, e.g., a LYCRA-type material, forming a flexible member that. extends over at least some of a wearer's knuckles.

Further, according to other aspects of the invention, glove structures as disclosed herein may be elastic free across the back of the hand, especially in the vicinity of the wearer's knuckles. Thus, according to certain embodiments, the elastic provided in prior art gloves may be replaced with a knuckle support assembly having a silicone rubber knuckle support member and a stretchable textile material flexible member. The knuckle support assembly is designed to provide a nice, comfortable, seamless feel across the back of the hand that stretches well over the knuckles while providing support between the knuckles and fingers. The knuckle support assembly further may prevent unsightly bunching of the glove and loss of support as commonly occurs when elastic is used.

FIGS. 1A through 5 illustrate various views of embodiments of glove structures 100 in accordance with this invention. A first embodiment of a glove structure 100 is illustrated in FIGS. 1A and 1B; a second embodiment is illustrated in FIGS. 2A and 2B; a third embodiment is illustrated, at least partially, in FIG. 3; a fourth embodiment is illustrated, at least partially, in FIG. 4; and a fifth embodiment is illustrated, at least partially, in FIG. 5.

Figure 1B:
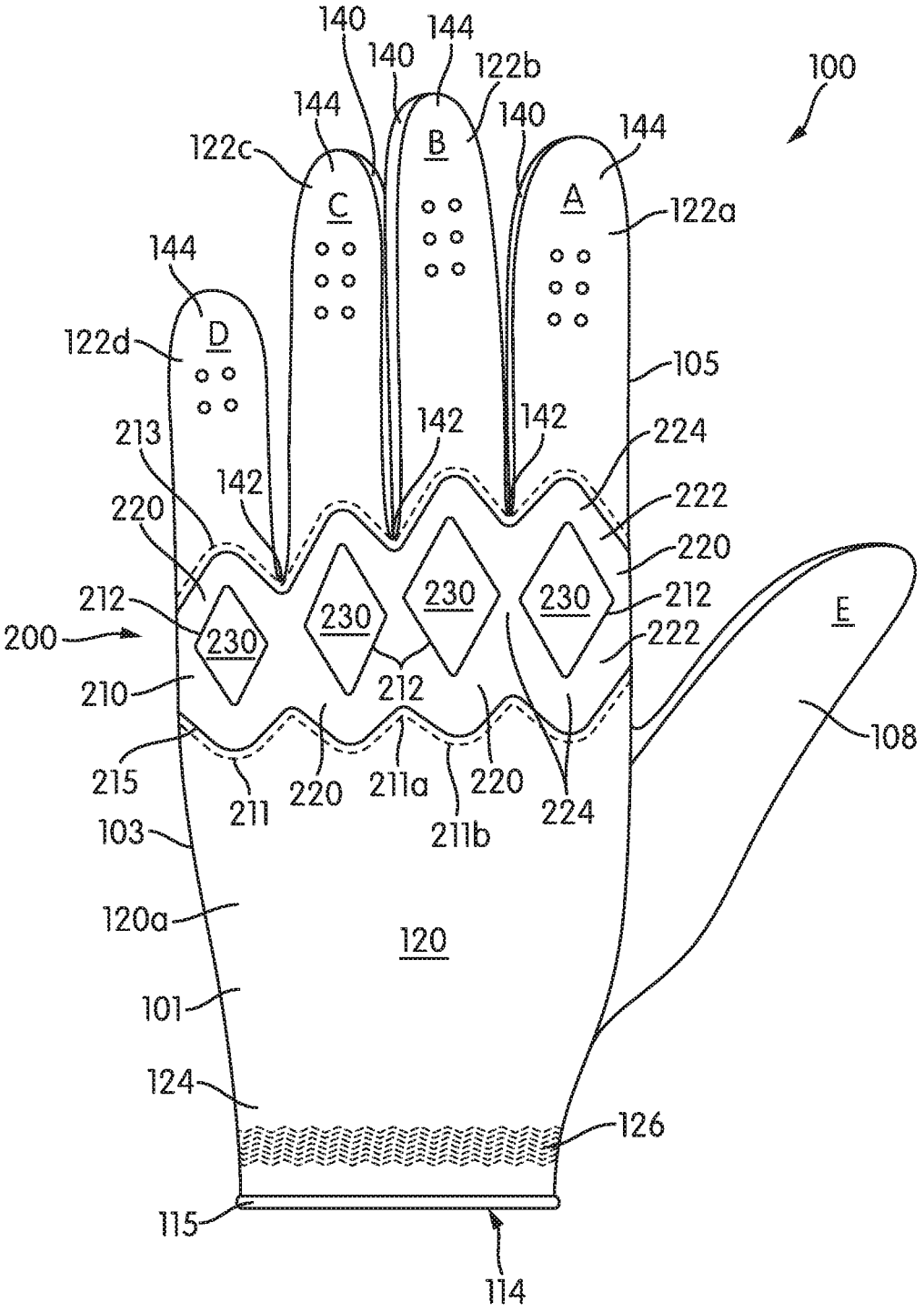

Specifically, FIG. 1A shows a front view and FIG. 1B shows a back view of a first embodiment. In this embodiment, glove structure 100 includes a main body 101 configured for receiving a metacarpal region of a wearer's hand, fingerstalls A, B, C, and D configured for receiving an index finger, a middle finger, a ring finger and a little finger, respectively, and thumb stall E configured for receiving a thumb. As shown, glove structure 100 may include a front portion 102, a back portion 120 and a thumb portion 108.

Referring to FIG. 1A, the front side of the glove structure 100 includes a front portion 102 that includes a palm-covering front main section 102*a* and four front finger sections 104 extending from the palm-covering front main section 102*a*. The four front finger sections 104 include an index-finger front section 104*a*, a little-finger front section 104*d*, and two intermediate front finger sections, a middle-finger front section 104*b* and a ring-finger front section 104*c*. If desired, the front finger sections 104 may include small holes 106 or other openings (e.g., slits etc.) to improve ventilation and breathability.

Generally front portion 102 may be made of any desired material. In this embodiment, front portion 102 is formed from leather materials (natural or synthetic, e.g., cabretta leather, calfskin, etc.) or any other desired material that provides suitable grip properties. As another alternative, the natural or synthetic leather materials may be applied to a base fabric layer (e.g., polyester, rayon, cotton, etc.), for example, as patches, at desired locations on the palm, fingers, and/or thumb. In the embodiment of FIG. 1A, front portion 102 is unitarily formed from a single piece of leather material. In general, front portion 102 may be formed of any number of pieces or parts and assembled via any of various constructions as would be known to persons of skill in the art given the benefit of this disclosure. Other suitable materials for the front section or portions thereof, as would be apparent to persons of ordinary skill given the benefit of this disclosure, may be used in various embodiments of this invention.

FIG. 1A further illustrates thumb portion 108 attached to the front portion 102 along thumb cutout 110. While it also may be made of any desired material, in this embodiment, at least the thumb stall 108*a* (shown in FIG. 1A) of the thumb portion 108 is formed from the same material as the front portion 102, e.g., a natural or synthetic leather material. Also, while in general it may be made of any desired construction, the thumb stall 108*a* of thumb portion 108 in this embodiment is formed from a single piece of material. Thumb portion 108 is joined to thumb cutout 110 in front main section 102*a*.

Figure 2A:
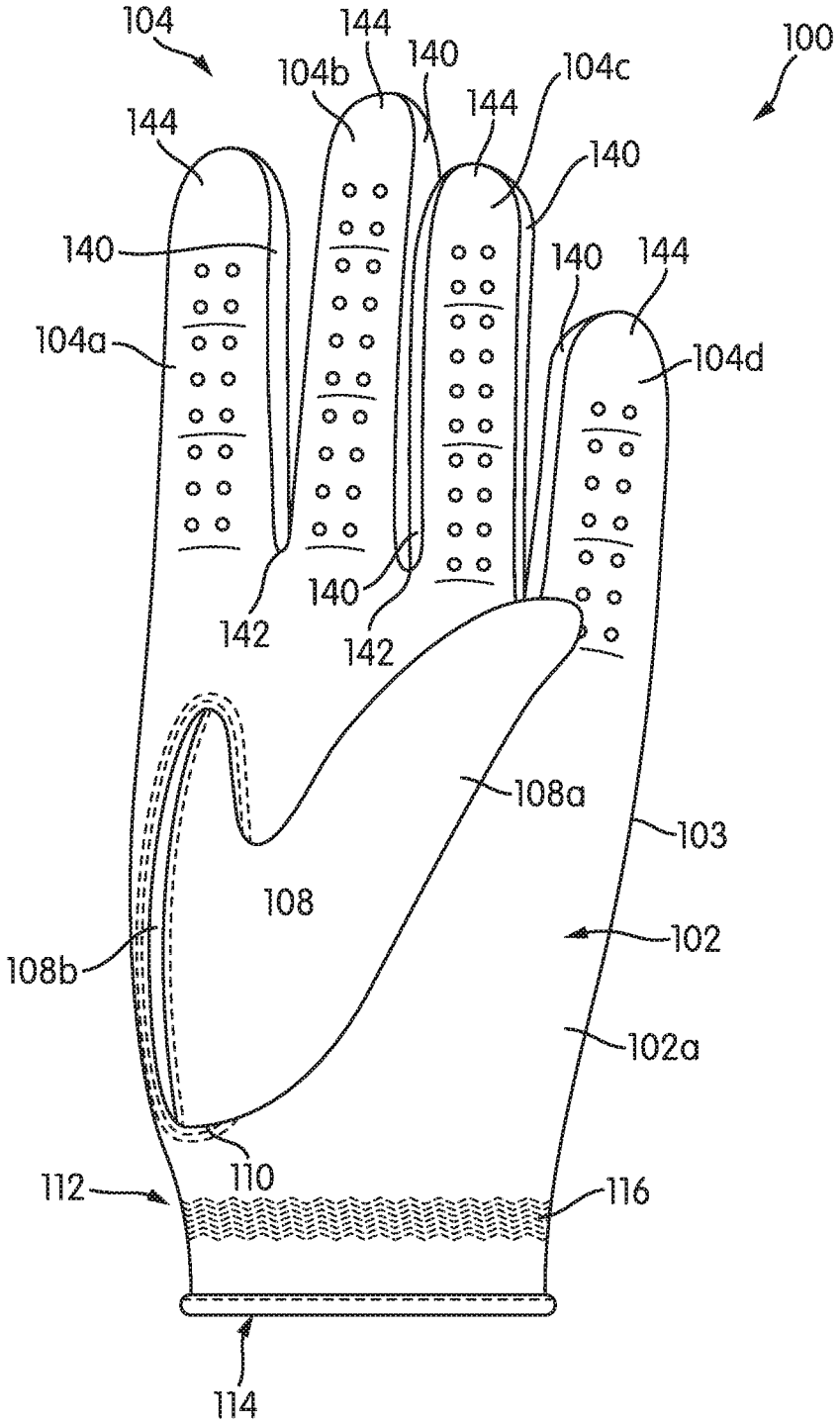
FIGS. 2A and 2B illustrate front and back views of another example glove structure in accordance with this invention.

Referring now to FIG. 2A, in this particular embodiment, an elongated thumb inset 108*b* may be located along thumb cutout 110 and along the outer-side seam (opposite to the palm-side) of thumb portion 108. Elongated thumb inset 108*b* may extend at least a majority of the distance from the bottom of thumb cutout 110 to the top of thumb cutout. In some embodiments (not shown), thumb inset 108*b* may be provided as an elongated gore set within the material of a base region of thumb portion 108, i.e., at least slightly away from the thumb cutout 110 (as opposed to being located along the cutout 110). Thumb inset 108*b* may be stitched to thumb portion 108. Thumb portion 108 and thumb inset 108*b* may both be stitched to front main section 102*a*. Alternatively, other techniques for attaching thumb portion 108 and/or thumb inset 108*b* to the glove structure 100, as would be known by persons of ordinary skill in the art given the benefit of this disclosure, may be used in keeping with the invention.

Elongated thumb inset 108*b* provides the thumb portion 108 with the capability to elastically conform to the various thumbs sizes and shapes of different users and to allow more freedom of movement in the thumb region. Elongated thumb inset 108*b* may be formed of a stretchable and/or shape-retention material.

For purposes of this disclosure, "stretchability" refers to the capability of the material to elastically elongate, extend, expand, etc. in the plane of the material when subjected to an applied in-plane tensile load, such that upon release of the load the material reverts to its original configuration. "Shape retention" refers to the capability of a planar material to return to its planar configuration after being subjected to an out-or-plane load.

In general, any desired elastically stretchable material may be used. According to certain embodiments, an elastically stretchable material that is also breathable may be preferable. Thus, for example, open mesh materials, synthetic suede, polyesters, rayons, nylon, or the like, and any combination thereof, may be considered suitable materials for the desired elastically stretchable material. Stretchable, extensible or elastically expandable materials may include materials having an inherent elastic extensibility or stretchability (for example, elastane fibers as included in Spandex® or LYCRA®-type materials, natural or synthetic latex fibers, etc.). According to certain embodiments, materials having at least 1% elastane fibers or at least 2% elastane fibers may be desired, although materials having greater than 0.5% elastane fibers may be suitable.

The stretchable, extensible or elastically expandable materials may include or be formed from various textile materials or fabrics. As noted above, examples of textile materials that may be used include Spandex® or LYCRA® or other stretchable synthetic materials. In some embodiments, the textile materials may be a blend of cotton, polyester and elastane fibers and may include hollow polyester fibers that wick moisture. Examples of such textile materials include fabrics sold under the name Dri-FIT® by NIKE, Inc. of Beaverton, Oreg. Such fabrics may move perspiration away from the wearer's skin to the garment surface where the perspiration can evaporate quickly so as to help keep the wearer dry and comfortable. The elastane fibers within the textile material stretch to provide a comfortable, personalized fit.

Additionally or alternatively, the configuration of the material itself (i.e., knit, mesh, looped, perforated, etc.) may contribute to the material's stretchability. Thus, according to some embodiments, the extensible material may be a textile material. According to other embodiments, the extensible material may be an elastomeric film, elastomeric sheet, or other relatively thin elastomeric layer. Such an elastomeric layer may be perforated. Further, such an elastomeric layer may be fiber reinforced. The elastically stretchable material may include a plurality of layers, including one or more textile material layers and/or one or more elastomeric material layers.

The stretchable or extensible material may be stretchable in one direction or in more than one direction. Further, the stretchability of the material may be different or the same in the different directions. For example, for the elongated thumb inset 108*b*, the stretchable material may be provided with its maximum extensibility oriented across the width (i.e., across the narrow dimension) of the inset 108*b*. According to some embodiments, a material having an elastic extensibility of greater than 100% in at least one direction may be suitable. Materials having an elastic extensibility of greater than 150% or even greater than 200% in at least one direction may be desired.

In some embodiments, the elongated thumb inset 108*b* may further extend around the base region of the thumb portion 108. In even other embodiments, an elongated thumb inset (not shown) may be provided on the palm-side of thumb portion 108. Optionally, a single elongated thumb inset 108*b* may extend completely, substantially completely, or a majority of the way, around the base region of the thumb portion 108, thereby providing even greater freedom of movement in the thumb region. In even other embodiments, thumb portion 108 need not include any elongated thumb inset 108*b*.

Referring now to FIG. 1B, the back portion 120 of an example glove structure 100 is shown. The back portion 120 is engaged directly or indirectly with the front portion 102 and covers a back of a wearer's hand. In this illustrated example, the back portion 120 includes a back main section 120*a* located opposite the palm-covering front main section 102*a* and four back finger sections 122 extending from the back main section 120*a* and located opposite the four front finger sections 104. An interior chamber for receiving the wearer's hand is defined between the front portion 102 and the back portion 120. A palm-receiving void is defined between the back main section 120*a* and the front main section 102*a*. The four back finger sections 122 include an index-finger back section 122*a*, a little-finger back finger section 122*d*, and two intermediate finger back sections, a middle-finger back section 122*b* and a ring-finger back section 122*c*.

If desired, the front portion 102 and the back portion 120 may be directly coupled to one another, e.g., by stitching or sewing or other techniques, for example, down the sides of the glove 100 and/or down the sides of the finger stalls A, B, C and D. This connection, however, may be indirect in some embodiments, at least in some areas of the glove structure 100. For example, at least some of the front finger sections 104*a* through 104*d* may be engaged with at least some of the back finger sections 122*a* through 122*d* at their side edges by fourchettes or gusset members 140.

As shown in FIG. 1A, gusset members 140 may be located between the front finger sections 104 and the back finger sections 122 and extend from the valley areas 142 to the fingertips 144. In particular, in this embodiment, gusset members 140 may be wider in the valley areas 142 at the base of the fingers and narrower at the fingertips 144.

Gusset members 140 may be formed of the same material as the front finger sections 104, of the same material as the back finger sections 122, or of a completely different material. As shown in the embodiment of FIGS. 1A and 1B, gusset members 140 may be formed of an elastically extensible material and may be formed of the same or similar material to that disclosed above with respect to the elongated thumb inset 108*b*.

Further, if desired, adjacent pairs of gusset members 140 which extend from a common valley area 142 may be formed as a unitary, one piece construction such that a single piece of gusset material extends through the valley areas 142 between finger sections. Additionally or alternatively, if desired, adjacent pairs of gusset members 140 which extend from a common fingertip area 144 may be formed as a unitary, one piece construction such that a single piece of gusset material extends over the fingertip area 144 of any given finger. As another example, if desired, all of the gusset members 140 may be formed as a unitary, one piece construction, e.g., a single piece of gusset material extends from the tip of the little finger to the tip of the index finger while forming all of the valley areas 142 therebetween.

Optionally, instead of gusset members 140 forming the sides of the fingers stalls A, B, C, and D, extra material of either the front finger sections 104 and/or the back finger sections 122 may be provided. Typically, this gusset-less construction reduces the number of seams required for manufacture. For purposes of this disclosure, the term "seam" refers to a junction or engagement area wherein at least to adjoining components are attached together. A seam need not be stitched, but may be formed via any suitable joining technique (e.g., stitching, bonding, fusing, etc.) as would be known to persons of ordinary skill in the art given the benefit of this disclosure.

In the various example structures described herein with respect to FIGS. 1A through 5, the front portion 102, the thumb portion 108, the back main section 120*a* and at least of portion of the back finger sections 122 may be made from the same material, e.g., a leather or leather-like material. The gusset members 140 and/or the elongated thumb inset 108*b* may be made from a different material, e.g., LYCRA® or Spandex®. Although these materials may be desirable, various other materials, as would be apparent to persons of ordinary skill given the benefit of this disclosure, are possible without departing from this invention.

Still referring to the embodiment of FIGS. 1A and 1B, the front portion further includes a wrist area 112 and the back portion 120 further includes a wrist area 124. Wrist areas 112, 124 are located near the opening 114 for receiving the wearer's hand. Wrist area 112 may include an elastic component 116 and/or wrist area 124 may include an elastic component 126 as a means for securing the glove structure snugly and comfortably to the user's hand. Elastic components 116, 126 may be formed as a single band or strap of elastic material that extends continuously around the wrist area. Typically, elastic components 116 and 126 would be located on the inside or in the interior of the wrist areas. In general, any number of elastic elements may be incorporated into the elastic components 116, 126 without departing from this invention. For example, a plurality of elastic elements, arranged in parallel and/or in series, may constitute means for securing the glove. Optionally, wrist areas 112, 124 may be provided by a separate cuff element. As an example, cuff element may be formed as a knitted and ribbed expandable element that is engaged with the front portion 102 and the rear portion 120 by sewing or stitching or in another desired manner. Alternatively, cuff element may be formed from an elastically stretchable material as describe above with respect to thumb inset 108*b*.

Thus, according to some embodiments, wrist opening 114 and/or the elastic component(s) 116, 126 in the wrist areas 112, 124 are sufficiently stretchable to enable the wearer to insert his/her hand without the need for a wider opening. Wrist area may also include edge piping 115. When edge piping 115 is provided around the wrist opening 114, the edge piping 115 may need to be discontinuous and/or sufficiently stretchable to accommodate the necessary stretching require for a wearer to insert his/her hand.

Figure 2B:
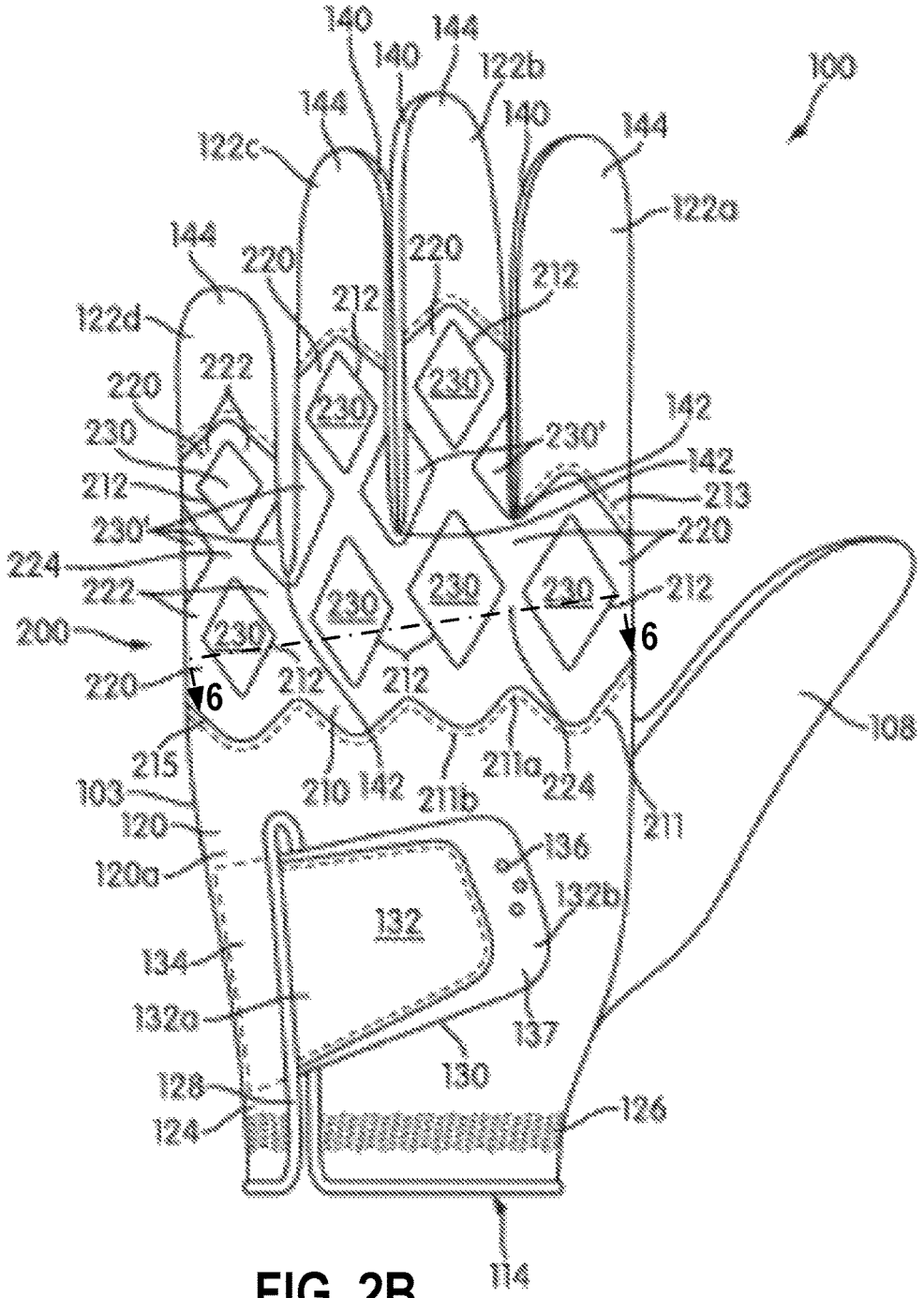

As shown in the embodiment of FIGS. 2A and 2B, the glove structure 100 may include an additional means for securing the glove. In FIG. 2B, glove 100 includes a glove opening slit 128 that increases the glove opening size to allow easy insertion and removal of a wearer's hand. Glove opening slit 128 may, optionally, includes a gore inset (not shown) between the edges of the glove opening slit 128. Such a gore inset may be elasticized or folded to accommodate the opening and closing of the slit 128. In one embodiment, gore inset may be formed of an elastic stretchable material as described above with respect to thumb inset 108*b*.

According to certain embodiments and still referring to FIGS. 2A and 2B, the glove opening slit 128 is closed off by a closure system 130, which may be attached to at least one of the front portion 102 and the back portion 120 of the glove 100. While any desired type of closure system 130 may be provided without departing from this invention, in this embodiment, the closure system 130 includes a flap 132 engaged with at least one of the front portion 102 and the back portion 120. The flap 132 may include a first portion a fastener and the back portion 120 may include a complementary portion of the fastener. Example fasteners may include hook-and-loop fasteners, snaps, magnets, buttons, etc. Flap 132 may be formed of a rubber or rubber-like material. In particular, flap 132 may include a layer of a silicone rubber having a thickness from 0.10 mm to 0.30 mm. Thus, according to some embodiments, flap 132 may be formed as a relatively inextensible flap.

As shown in FIG. 2B, flap 132 may include an attached or proximal end 132*a* and a free end or distal end 132*b*. An elastic band 134 may extend from the outside seam (e.g., seam 103) to the attached edge 132*a* of flap 132 so that, when the flap 132 is secured, the glove structure 100 can be elastically snugged around the wearer's hand. Elastic band 134 is typically located in the interior of the glove structure 100. Still referring to FIG. 2B, the complementary fastening systems, e.g., a hook-and-loop system, may stop short or lie inboard of the distal or free end 132*b* of flap 132. In such instance, the distal end 132*b* of flap 132 becomes a free end tab 137 providing a grasping portion, wherein a user may easily grasp both sides of the free end 132*b* of the flap 132.

Further, one or more tactile elements 134 may be provided the free end tab 137 at the distal end 132*a* of flap 132 to assist a user in gripping the flap 132 when fastening and/or unfastening the flap 132 to the back portion 120. In this particular embodiment, tactile element 134 is provided as a one or more raised bumps or protrusions. In other embodiments, tactile element 134 may be provided as thickened portions, folded portions, indentations, textured surfaces, raised ribs, etc. According to certain embodiments, when the free end tab 137 is formed at least partially of a silicone rubber, the at least one tactile element 134 may be provided as a silicone rubber raised protrusion extending from the silicone rubber of the free end tab 137.

Figure 4:
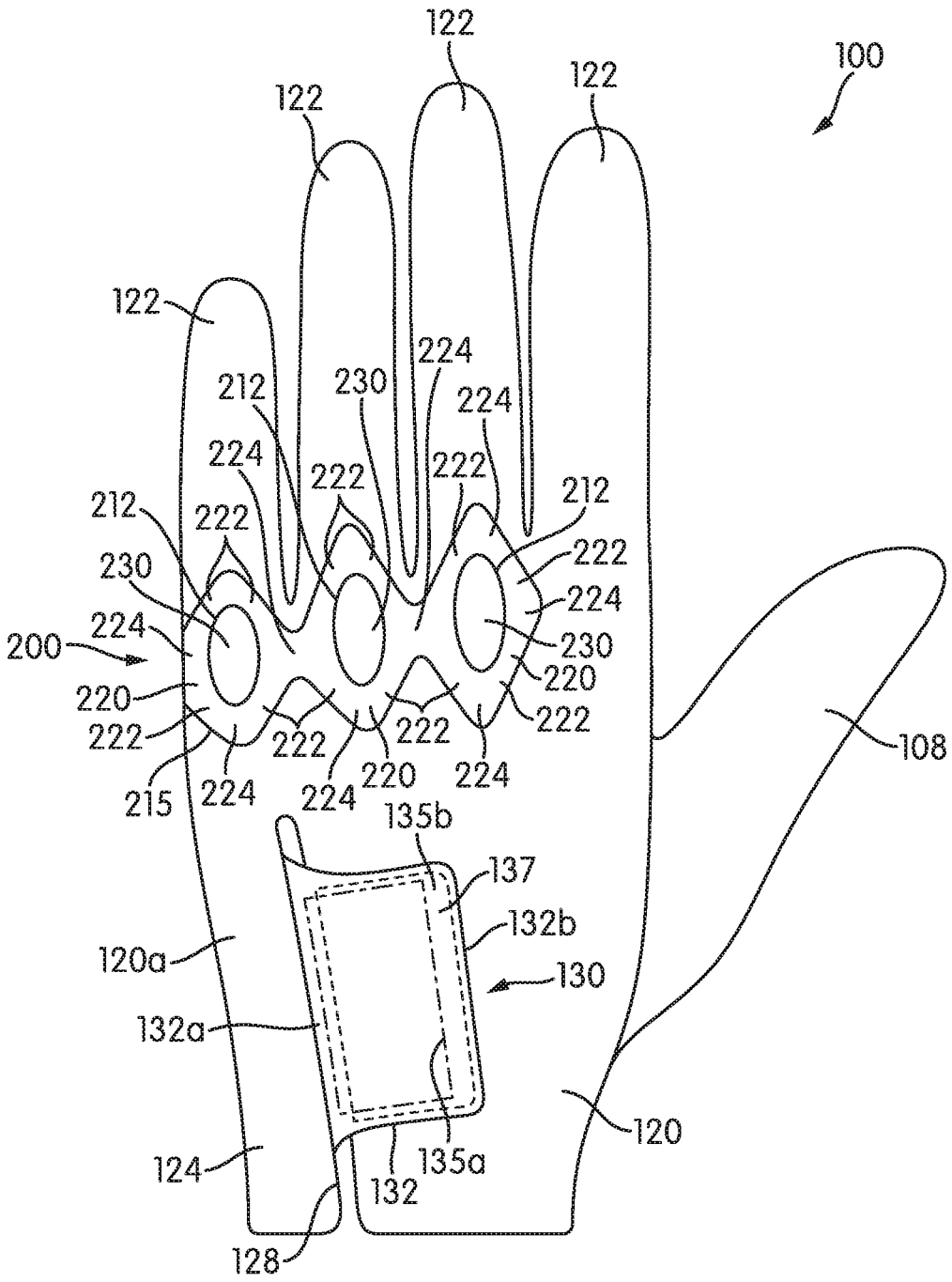
FIG. 4 illustrates a back view of still another example glove structure in accordance with this invention.

Referring now to the embodiment of FIG. 4, a flap 132 may be fastened to the back main section 120*a* with a hook-and-loop fastener system having unequal hook and loop areas. The hook portion 135*a* of the hook-and-loop fastener may be fastened to the back main section (shown schematically in FIG. 4 as a dash-dot line); the loop portion 135*b* may be fastened to the flap 132 (shown schematically in FIG. 4 as the dashed line). Thus, it can be seen that the loop portion 135*b* extends to the distal end 132*b* of flap 132, while the hook portion 135*a* may lie inboard of the distal end 132*b* of flap 132. The distal end 132*b* of flap 132 that extends beyond hook portion 135*a* may be used as a grasping portion or free end tab 137 (tactile elements 134 may be provided on this flap 132, if desired).

Figure 3:
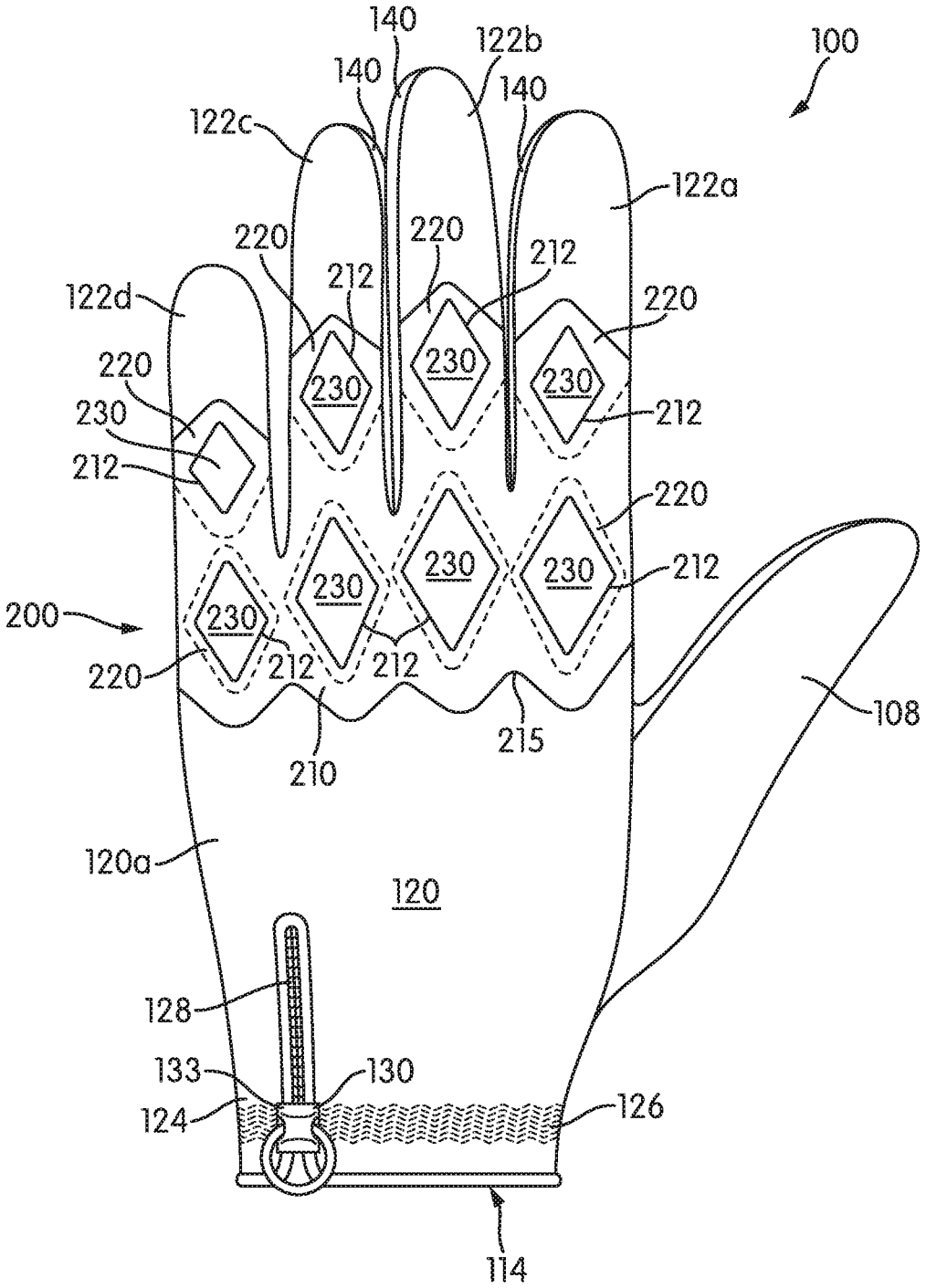
FIG. 3 illustrates a back view of yet another example glove structure in accordance with this invention.

In other embodiments, for example, as shown in FIG. 3, a glove opening slit 128 may be opened and closed with a zipper or zipper-type fastening component 133. Thus, zipper-type components or other continuously interlocking, elongated fastening systems (with or without sliding elements) may be provided as part of a closure system 130. Such zipper-type components may be provided as Ziploc®-type closure elements, with or without a slider.

Figure 5:
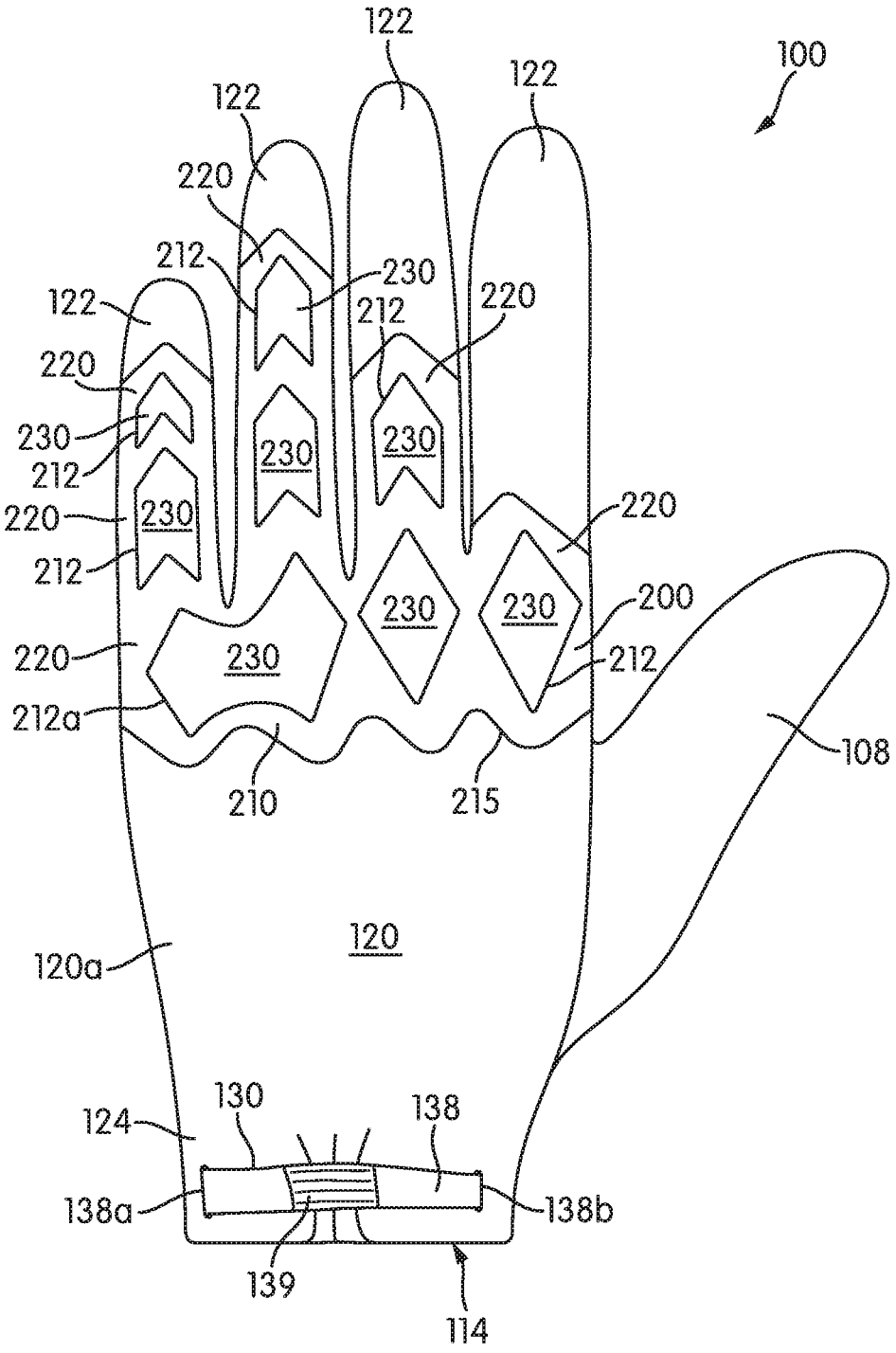
FIG. 5 illustrates another back view of an example glove structure in accordance with this invention.

In even other embodiments, for example, as shown in FIG. 5, a closure system 130 may include a strap 138 that includes an elastic, stretchable portion 139. Strap 138 may be attached or fastened at both ends 138*a*, 138*b* on either side of a glove opening slit (like slit 128 shown in FIG. 2B). Optionally, as shown in FIG. 5, strap 138 may be provided without any glove opening slit. During insertion and removal of a wearer's hand, strap 138 remains attached or fastened to the back portion 120 of glove 100. Ease of insertion and removal of a wearer's hand is facilitated by the stretching of the elastic portion 139. Thus, it can be seen that various means for securing the glove snugly around the user's wrist, including various elastic components, closure systems 130, and any combination thereof, may be provided without departing from the invention.

Referring back to FIG. 1B, the back portion 120 of the glove structure 100 includes at least one knuckle support assembly 200. The knuckle support assembly 200 of this illustrated example extends between the back main section 120*a* and one or more of the back finger sections 122. Knuckle support assembly 200 includes a knuckle support member 210 and a flexible member 230. The knuckle support assembly 200 may extend across a majority of the knuckle region of the wearer's hand. In the embodiment of FIG. 1B, knuckle support assembly 200 forms a continuous path from a first side (i.e., an outer side or little finger-side) of the back portion 120 to the opposite side (i.e., an inner side or index finger-side) of the back portion 120. Indeed, in this particular embodiment, knuckle support assembly 200 extends from edge-to-edge of the back portion 120.

The knuckle support member 210 includes one or more cutouts 212 which may be located over or aligned with one or more of the top knuckles (i.e., the metacarpophalangeal joints) of the user (when a user's hand is inserted into the glove structure 100). Thus, a knuckle support member 210 may include a knuckle cutout 212 for the top knuckle of the index finger; a knuckle cutout 212 for the top knuckle of the middle finger; a knuckle cutout 212 for the top knuckle of the ring finger; and/or a knuckle cutout 212 for the top knuckle of the little finger. According to some embodiments, there may be an individual knuckle cutout 212 for each of the four top knuckles, i.e., there may be a one-to-one correspondence between each top knuckle and each top knuckle cutout 212. Optionally, the knuckle support member 210 may include knuckle cutouts 212 for less than all of the top knuckles. As an example, the knuckle support member 210 may include a knuckle cutout 212 for the top knuckle of the index finger and a knuckle cutout 212 for the top knuckle of the middle finger. Alternatively, referring to FIG. 4, the knuckle support member 210 may include individual knuckle cutouts 212 for the top knuckles of the little finger, the middle finger and the index finger.

For purposes of this disclosure, the term "cutout" refers to any opening, aperture, hole, orifice, gap, etc. Any suitable method may be used to form the cutout, including cutting, stamping, molding, piecing, framing, etc. Further, a cutout need not be completely framed or encircled by the knuckle support member 210. Thus, according to certain embodiments, a cutout may be fully encircled by a closed frame, while according to other embodiments, a cutout may be only partially encircled by an open frame.

According to certain aspects and referring to FIGS. 2B, 3 and 5, the knuckle support member 210 may include knuckle cutouts 212 for at least some of the proximal knuckles (i.e., the proximal interphalangeal joints). Thus, a knuckle support member 210 may include a knuckle cutout 212 for the proximal knuckle of the index finger; a knuckle cutout 212 for the proximal knuckle of the middle finger; a knuckle cutout 212 for the proximal knuckle of the ring finger; and/or a knuckle cutout 212 for the proximal knuckle of the little finger. According to some embodiments, the knuckle support member 210 may include a knuckle cutout 212 for only some of the proximal knuckles. As another example and referring specifically to FIG. 2B, the knuckle support member 210 may include a knuckle cutout 212 for the proximal knuckle of the middle finger, a knuckle cutout 212 for the proximal knuckle of the ring finger, and a knuckle cutout 212 for the proximal knuckle of the little finger.

According to even other aspects and referring, for example, to FIG. 5, the knuckle support member 210 may include one or more knuckle cutouts 212 for the distal knuckles (i.e., the distal interphalangeal joints). Thus, a knuckle support member 210 may include a knuckle cutout 212 for the distal knuckle of the index finger; a knuckle cutout 212 for the distal knuckle of the middle finger; a knuckle cutout 212 for the distal knuckle of the ring finger; and/or a knuckle cutout 212 for the distal knuckle of the little finger.

According to certain embodiments, a single knuckle cutout 212 may be provided for two or more knuckles. Thus, for example, still referring to FIG. 5, a single knuckle cutout

212*a* may extend around the top knuckles of both the little finger and the ring finger. As another example (not shown), a single knuckle cutout 212 may extend around the top knuckle and the proximal knuckle for any given finger.

Thus, it has been disclosed that knuckle cutouts 212 may be formed with various sizes and shapes. According to certain embodiments, the knuckle cutouts 212 may all have the same size and shape. Alternatively, the knuckle cutouts 212 may have the same or similar shape, yet be sized according to the general size of the knuckles. Thus, for example, a knuckle cutout 212 for the top knuckle of the index finger may have an area ranging from 80.0 $mm^2$ to 150.0 $mm^2$, while a knuckle cutout 212 for the top knuckle of the little finger may have an area ranging from 40.0 $mm^2$ to 100.0 $mm^2$. As another example, the areas of the knuckle cutouts 212 for the top knuckles and the proximal knuckles for any given finger may be substantially the same-the area of the proximal knuckle cutout 212 may be within ±20% of the area of the top knuckle cutout 212 for the same finger.

Optionally, different shaped cutouts 212 may be provided for the different knuckles. According to some embodiments, the knuckle cutouts 212 may be longer in the longitudinal direction than in the lateral direction. For example, the knuckle cutout 212 may be shaped as a diamond having a greater longitudinal length between points of the diamond and a lesser lateral width. The diamond-shaped cutout 212 may be generally centered over the center of the knuckle. The greater longitudinal length of the cutout 212 may provide a more desirable degree of flexibility as the finger associated with the cutout 212 is curled. Referring to FIG. 4, cutouts 212 are shown with substantially oval shapes. Referring to FIG. 5, cutouts 212 are shown with diamond, arrow and irregular shapes. Other knuckle cutout shapes may include circles, ellipses, rectangles, slits, etc. and other symmetrical, non-symmetrical, regular, or irregular shapes. Suitable knuckle cutout shapes would be apparent to persons of ordinary skill in the art given the benefit of this disclosure.

According to certain aspects and as best shown in FIGS. 1B, 2B and 4, knuckle support member 210 may be formed as a web structure having a plurality of elongated segments 222 interconnected at junctions 224. The elongated segments 222 may extend around and frame 220 one or more of the user's knuckles. Further, the knuckle support member 210 may form a plurality of frames 220 extending around the cutouts 212 and around the top knuckles of the user. Even further, referring to FIGS. 2B, 3 and 5, knuckle support member 210 may form a plurality of frames 220 extending around various proximal and/or distal knuckles of the fingers. The frames 220 of knuckle support member 210 may encircle and support the wearer's individual knuckles.

The size(s), location(s), and/or extent of the frames 220, elongated sections 222 and/or junctions 224 of the knuckle support member 210 may be selected and arranged so as to provide the desired level of support and/or stretch resistance and/or to provide an overall desired aesthetic appearance to the glove structure 100. As shown in the embodiment of FIG. 2B, a single knuckle support member 210 may be provided. If desired, one or more knuckle support members 210 may be provided. For example, a first knuckle support member may provide cutouts for one or more of the top knuckles and one or more additional knuckle support members may provide cutouts for one or more of the proximal and/or distal knuckles.

According to some aspects, knuckle support member 210 may have a wave-like or undulating proximal edge 215 extending transversely at least partially across the back of the glove structure 100. For purposes of this disclosure, "wave-like" refers to a curved, non-linear feature and may encompass regular and irregular cyclic features. "Undulating" refers to a curved, non-linear feature that need not necessarily be cyclical. The wave-like or undulating proximal edge 215 may further enhance the overall flexibility of the knuckle support member 210 and the knuckle support assembly 200.

According to certain aspects, the knuckle support member 210 may act as a doubler, providing additional strength, enhancing durability and optimizing support. For example, knuckle support member 210 may be flexurally stiffer than the material(s) forming the back main section 120*a* and the back finger sections 122. Thus, knuckle support member 210, when properly fit to and positioned on a user's hand, may provide support for the fingers and encourage the proper positioning of the fingers while gripping an object.

For example, referring to FIG. 1B, knuckle support member 210 may be located in close proximity to and extend across the valley area 142 of two adjacent fingers, e.g., the index finger and the middle finger. This extra support along the back of the user's hand adjacent to the valley area may encourage the correct relative positioning of these two fingers, such that, for example, the fingers are held closer together to provide a tighter grip. Conversely, referring to FIG. 2B, knuckle support member 210 may be positioned away from the valley area 142 of, for example, the little finger with the ring finger and the ring finger with the middle finger, while being positioned in close proximity to the valley area 142 between the index finger and the middle finger. Positioning the knuckle support member 210 away from the valley area 142 between adjacent fingers may provide greater flexibility and foster the easy spreading of these fingers, thereby facilitating a wider extension of the fingers (for example, on the little finger-side of the grip).

The cutouts 212 of the knuckle support member 210, when positioned over or aligned with the knuckle joints of a wearer's hand, may provide beneficial flexibility in the immediate region of the knuckles. Even further, according to some embodiments, knuckle support member 210 may be formed with a varying degree of flexibility or, conversely, a varying degree of stiffness. Different thicknesses, different materials, multiple layers, etc. may be used to provide such a varying and selective degree of flexibility. For example, where greater stiffness of the knuckle support member 210 is desired, the knuckle support member 210 may be provided with an increased thickness, a second layer of material, a stiffer material, etc. Thus, for example, in the embodiment of FIG. 3, although knuckle support member 210 continuously extends from side-to-side and from below the top knuckles to distally of the proximal knuckles, the flexural stiffness of knuckle support member 210 need not be constant across this entire region. Specifically, the thickness (and thus, also the flexural stiffness) of the knuckle support member 210 may be greater around the cutouts 212 (e.g., in the frame regions 220) than between the frame regions (e.g., in the far field region). Zones of increased thickness may provide additional support in certain regions. In FIG. 3, the increased stiffness in the frame regions 220 around the cutouts 212 is schematically shown by dashed lines. According to another embodiment (not shown), a zone of increased thickness may be provided in the index finger region, while a zone of relatively decreased thickness may be provided in the little finger region.

Optionally, the knuckle support member 210 or portions thereof may be provided with a preset curvature to provide further support and facilitate proper positioning of the fingers. As a more specific example, if desired, the material of the knuckle support member 210 may be molded or otherwise formed into a pre-curved configuration such that even before a wearer dons the glove structure (i.e., in an initial configuration), at least a portion of the knuckle support member 210 is curved. The axis of curvature may extend across the knuckle or central portion of the knuckle support member 210 from side-to-side (e.g., as if the wearer's hand was grasping a rod and the axis of curvature is aligned with the axis of the rod). According to certain embodiments, the pre-curved configuration may be limited to the top knuckle region, while any portions of the knuckle support member 210 that may extend into the finger areas may remain uncurved in an initial configuration. As an example embodiment, a knuckle support member 210 may include one or more convexly curved frames 220 or elongated elements 222 extending across the top knuckle region, i.e., from a distal region of the top knuckle region to a proximal region of the top knuckle area. Further, as another example, the knuckle support member 210 may be provided with a preset curvature in the index finger top knuckle region, but not provided with any preset curvature in the little finger top knuckle region.

According to certain embodiments, the preset curvature may shape the knuckle support member 210 to correspond to the shape of the hand when gripping something. Alternatively, the preset curvature may shape the knuckle support member 210 to correspond to the shape of the hand in a relaxed position. This preset curvature may be accomplished, for example, by molding the knuckle support member 210 in this manner (e.g., by injection molding), by applying heat and pressure to the knuckle support member around a curved platen or post, or in any other desired manner.

According to other aspects, knuckle support member 210 may be more elastically stretchable than the back main section 120*a*. Further, knuckle support member 210 may be more elastically stretchable than the back finger sections 122. In other words, relative to the material of the back main section 120*a* and/or the material of the back finger sections 122, knuckle support member 210 may have a relatively high degree of in-plane elastic stretchability. Thus, immediately around the various knuckles regions, a greater degree of flexibility, comfort and conformance may be provided. Additionally, knuckle support member 210 may be provided with a relatively high degree of out-of-plane elastic stiffness. Thus, relative to the material of the back main section and/or the material of the back finger sections 122, knuckle support member 210 may have a relatively high degree of flexural stiffness. In other words, in some embodiments, knuckle support member 210 may stretch easily, but not drape as readily as the material of the back main section 120*a* and/or the material of the back finger sections 122.

According to other aspects and referring to FIGS. 1B, 2B, 3, 4 and 5, a flexible member 230 may extend across one or more of the cutouts 212 or framed portions of the knuckle support member 210. Flexible member 230 may have a relatively high degree of in-plane elastic stretchability and/or a relatively high degree of out-of-plane elastic flexibility. In other words, flexible member 230 may stretch easily and/or flexible member 230 may bend or drape easily.

In general, any desired elastically stretchable material may be used for flexible member 230. According to certain embodiments, an elastically stretchable material that is also breathable may be preferable. Thus, for example, open mesh materials, synthetic suede, polyesters, rayons, nylon, or the like, and any combination thereof, may be considered suitable materials for the desired elastically stretchable material. Stretchable, extensible or elastically expandable materials may include materials having an inherent elastic extensibility or stretchability (for example, elastane fibers as included in Spandex® or LYCRA®-type materials, natural or synthetic latex fibers, etc.). According to certain embodiments, materials having at least 1% elastane fibers or at least 2% elastane fibers may be desired, although materials having greater than 0.5% elastane fibers may be suitable.

The stretchable, extensible or elastically expandable materials may include or be formed from various textile materials or fabrics. As noted above, examples of textile materials that may be used include Spandex® or LYCRA® or other stretchable synthetic materials. In some embodiments, the textile materials may be a blend of cotton, polyester and elastane fibers and may include hollow polyester fibers that wick moisture. Examples of such textile materials include fabrics sold under the name Dri-FIT® by NIKE, Inc. of Beaverton, Oreg. Such fabrics may move perspiration away from the wearer's skin to the garment surface where the perspiration can evaporate quickly so as to help keep the wearer dry and comfortable. The elastane fibers within the material stretch to provide a comfortable, personalized fit.

Additionally or alternatively, the configuration of the material itself (i.e., knit, mesh, looped, perforated, etc.) may contribute to the material's stretchability. Thus, according to some embodiments, the extensible material may be a textile material. According to other embodiments, the extensible material may be an elastomeric film elastomeric sheet, or other relatively thin elastomeric layer. Such an elastomeric layer may be perforated. Further, such an elastomeric layer may be fiber reinforced. The elastically stretchable material may include a plurality of layers, including one or more textile material layers and/or one or more elastomeric material layers.

The stretchable or extensible material may be stretchable in one direction or in more than one direction. Further, the stretchability of the material may be different or the same in the different directions. For example, for the flexible member 230, the stretchable material may be provided with its maximum extensibility being longitudinally oriented, i.e., in a proximal-to-distal direction, of the cutout 212. According to some embodiments, a material having an elastic extensibility of greater than 100% in at least one direction may be suitable. Materials having an elastic extensibility of greater than 150% or even greater than 200% in at least one direction may be desired.

Although, according to certain embodiments, flexible member 230 extends across all of the cutouts 212 of the knuckle support member 210, in general, not every cutout 212 need be covered. In other words, one or more of the cutouts 212 may remain open and uncovered, without having flexible member 230 extending there across.

Flexible member 230 may be attached to the knuckle support member 210 to form knuckle support assembly 200. According to certain embodiments, the flexible member 230 may be attached to the individual frames 220 extending around the knuckles. Specifically, the flexible member 230 may be attached to the edges of the cutouts 212.

Figure 6:
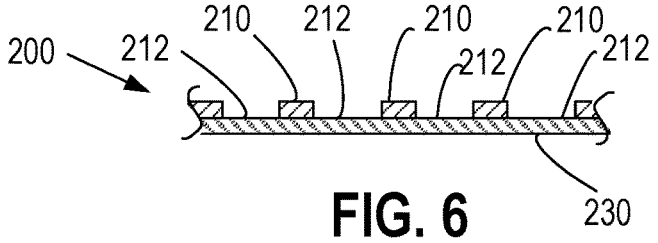
FIG. 6 illustrates a partial cross-sectional view of the example glove structure of FIG. 2B in accordance with this invention.

In addition, according to some embodiments, flexible member 230 may be coextensive with the perimeter edges of the knuckle support member 210. For example, the flexible member 230 may be provided as a continuous layer that extends under the entire knuckle support member 210 as shown in FIG. 6. Further, flexible member 230 may be attached to the perimeter edges of the knuckle support member 210. Flexible member 230 may also be provided as multiple pieces. The multiple pieces may be joined to form a continuous layer or they may remain discrete, thereby forming a discontinuous layer. The multiple pieces may be constructed of the same material or of different materials. If formed of the same material, the multiple pieces of the flexible member 230 may have any of various thicknesses and/or number of layers.

According to certain embodiments, flexible member 230 may extend beyond the perimeter edges of the knuckle support member 210. For example, as shown in FIG. 2B, portions of flexible member 230' are not located within cutouts 212 and are not located over any specific knuckle. These portions of the flexible member 230' may provide additional flexibility in areas removed from the immediate knuckle regions, for example, adjacent to certain of the valley areas 142 of the glove structure 100.

Flexible member 230 may be more stretchable than the back main section 120*a*. Flexible member 230 may be more stretchable than the back finger sections 122. Even further, flexible member 230 may be more stretchable than the knuckle support member 210. Further, the material of flexible member 230 may have a greater degree of shape retention as compared to the material of the back main section 120*a* and/or the back finger sections 122. Thus, immediately over the various knuckle regions, a greater degree of flexibility, comfort and conformance may be provided.

According to certain aspects, the knuckle support member 210 may have a significantly greater flexural stiffness than the flexible member 230 to which it is joined. Thus, according to some embodiments, the knuckle support assembly 200 may have substantially the same flexural stiffness as the knuckle support member 210 by itself. In other words, the addition of the flexible member 230 may not appreciably increase the flexural stiffness of the knuckle support assembly 200 above the flexural stiffness of the knuckle support member 210. For example, the flexural stiffness of the knuckle support assembly 200 may be within 5% of the flexural stiffness of the knuckle support member 210. In other examples, the flexural stiffness of the knuckle support assembly 200 may be within 10% or even within 15% of the flexural stiffness of the knuckle support member 210.

Further, knuckle support member 210 may have a greater flexural stiffness than the various sections of the back portion 120 to which it is joined. Thus, the knuckle support member 210 may provide at least a local increase in the flexural or bending stiffness of the glove structure 100. This may provide additional support to the wearer's knuckles, particularly when the hand is flexed.

The knuckle support assembly 200 may be made from molded rubbers, molded thermoplastics, TPUs, TPRs, etc. for the knuckle support member 210 and an elastically stretchable material, as described above, for the flexible member 230. According to certain embodiments, the knuckle support member 210 may be a silicone rubber or other rubber-like material and the flexible member 230 may be a Spandex®, LYCRA®, Dri-FIT® type of textile material. Although these materials may be desirable, various other materials, as would be apparent to persons of ordinary skill given the benefit of this disclosure, are possible without departing from this invention. Further, the knuckle support member 210 may be over-molded, fuse bonded, adhesive bonded, etc. to the flexible member 230. Thus, according to certain embodiments, a silicone rubber knuckle support member 210 may be over-molded to a Dri-FIT® flexible member 230; a silicone rubber knuckle support member 210 may be fuse bonded to a Dri-FIT® flexible member 230; or a silicone rubber knuckle support member 210 may be adhesively bonded to a Dri-FIT® flexible member 230.

Various designs or arrangements of the knuckle support assembly 200 are possible without departing from this invention. Increasing the overall stiffness of the knuckle support member 210 provides a more stable fit, and greater support. In contrast, the knuckle cutouts 212 provide the desired flexibility. Localized increases in the in-plane stiffness and/or the flexural or bending stiffness of the knuckle support member 210 may be achieved by increasing the amount of material in the frames 220, elongated elements 222 and/or junctions 224 or by using inherently stiffer materials. Thus, the knuckle support assembly 200 described herein provides greater flexibility in tailoring the glove structure 100 to any specific desired stiffness.

According to some aspects, the majority of the back finger section 122 of the index finger may be constructed of a conventional material, for example, the natural or synthetic leather disclosed above. Providing the knuckle support member 210 only in the vicinity of the top knuckle of the index finger, such that the remainder of the index finger (i.e., over the proximal and distal knuckle regions) is covered with the leather (or other gripping material) may be advantageous. This is because many golfers overlap their fingers when gripping a golf club shaft such that the little finger of the bottom hand (which is typically un-gloved) overlies and lays on the back of the index finger of the top hand (i.e., the gloved hand). Maintaining the higher grip material (i.e., for example, a leather material of back finger section 122 as opposed to a LYCRA®-type material of flexible member 230) along most of the length of the index finger potentially keeps the little finger from slipping during the golf swing, provides the golfer with a conventional feel, and provides a more stable grip.

Also, in the illustrated embodiments, the knuckle support assembly 200 engages only the back portion 120 (e.g., from one side seam 103 of the glove 100 to the other side seam 105). However, if desired, the knuckle support assembly 200 may extend around the sides of the glove structure 100 and engage and/or at least partially overlap the front portion 102. Further, as illustrated in FIG. 4, the knuckle support assembly 200 need not extend all of the way to the extreme edges of the back portion 120, but may extend only part of the way across the transverse width of the back portion 120.

Additional aspects relate to methods for making glove structures and/or components thereof. Such methods may include: (a) attaching a knuckle support member 210 to a flexible member 230 to form a knuckle support assembly 200; (b) attaching the knuckle support assembly 200 to a back main section 120*a* of a back portion 120 of the glove structure 100; and (c) attaching the knuckle support assembly 200 to back finger sections 122 of a back portion 120 of the glove structure 100. The knuckle support member 210 may be joined to the flexible member 230 by over-molding (or other molding techniques, including compression molding, pour molding, co-molding, etc., as may suitable for specific materials), fuse bonding, sewing, adhesive bonding, etc. Over-molding is an injection molding process where one material is molded onto a second material. The over-molded material generally forms a strong bond with the second material that is maintained in the end-use environment. The use of primers or adhesives during the over-mold process is typically not required to achieve an optimum bond between the two materials. Fuse bonding may be accomplished by using heat and pressure, H/F welding, R/F welding, laser welding, hot melt pressing, etc. The seam or junction formed by joining the knuckle support member 210 to the flexible member 230 (whether via over-molding, fuse bonding, sewing, adhesive, etc.) may be a flexible, non-rigid seam. It may be desirable to have a flexible seam that does not appreciably (or only minimally, if at all) increase the flexural stiffness of the frames 220 extending around the knuckle cutout 212 regions.

Further, the knuckle support assembly 200 may be joined to sections of the back portion 120 (e.g., the back main section 120*a* and the back finger sections 122). For example, the back main portion 102*a* and the knuckle support assembly 200 may be engaged to each other below the metacarpophalangeal knuckle region. The engagement of the knuckle support assembly 200 to the back main portion 102*a* may extend substantially straight across the back of the glove structure 100, from the outside of the little finger to the thumb-side of the index finger. Alternatively, as shown in FIGS. 1B and 2B, to provide a greater degree of flexibility across the back of the glove structure 100, the engagement line 211 may be wave-like or undulating. According to some embodiments, and still referring to FIGS. 1B and 2B, the undulations of the engagement line 211 may follow the knuckles, in that undulation peaks 211*a* may be aligned between the knuckles and undulation troughs 211*b* may be aligned with the knuckles. The peak-to-trough distance may be greater than 0.4 mm, greater than 0.6 mm, greater than 0.8 mm or even greater than 1.0 mm. Optionally, the peak-to-trough distance may range from 0.3 mm to 1.5 mm. If desired, the peak-to-trough distance may range from 0.3 mm to 1.0 mm, from 0.3 mm to 0.7 mm, or even from 0.3 mm to 0.5 mm.

The knuckle support assembly 200 may be joined to sections of the back portion 120 by sewing, adhesive bonding, fuse bonding, etc. Other engagement techniques, as would be known to persons of ordinary skill in the art given the benefit of this disclosure, may be suitable. For purposes of this disclosure, a stitch line form with zig-zag stitches (i.e., the individual stitches zig-zag) is not considered to be a wave-like or undulating stitch line unless the line formed by a plurality of the individual stitches curves or undulates. For additional strength and durability, a double line of stitching may be provided.

The knuckle support assembly 200 may similarly be joined to the individual back finger sections 122. The individual stitch lines 213 may extend transversely straight across the back of the fingers. Alternatively, the stitch lines 213 may undulate such that stretching the undulation may provide an additional measure of flexibility. Other suitable joining techniques and configurations would be apparent to persons of ordinary skill in the art given the benefit of this disclosure.

Still other aspects of this invention relate to methods for making glove structures 100 and/or components thereof that may include attaching the back portion 120 to a front portion 102 of the glove structure 100. For example, referring to FIGS. 1A and 1B, the back portion 120 may be formed separately from the front portion 102 and the two portions may be attached to each other by forming first and second side seams 103, 105. The first seam 103 may extend from the wrist region to the fingertip region along the outer side (or little finger-side) of the glove structure 100. Thus, seam 103 may be formed along the outer side of the little finger. The second seam 105 may extend from the wrist regions 112, 124 to the fingertip region 144 along the inner side (or thumb-side) of the glove structure 100. Thus, seam 105 may be formed along the thumb side of the index finger. Alternatively, the back main section 120*a* may be unitarily provided with a front portion 102 as part of a flat glove blank and a method for making a glove 100 may include overlapping the back main portion 120*a* of the glove blank with the front portion 102 of the glove blank and joining the edges of the overlapped portions to each other with a single seam to form a palm-receiving void. For example, referring to FIGS. 2A and 2B, a glove blank may be formed with the back main section 120*a* and the front portion 102 being continuous across the thumb side of the palm-receiving void and the thumb side of the index finger, such that the palm-receiving void is formed without a thumb-side seam. In other words, in this embodiment, there is no seam 105. In some embodiments, the overlapped portions of the glove blank may be seamed along a little finger-side of the palm-receiving portion. In other embodiments, the overlapped portions of the glove blank may be seamed along the back of the palm-receiving portion. In such instance, the edges of a left main back section and a right main back section may be brought together and seamed.

Other methods for making glove structures 100 and/or components thereof may include attaching a thumb portion 108 to the front portion 102. As described above, the thumb portion 108 may include a stretchable, elongated inset 108*b*. The inset 108*b* may be stitched to the thumb stall to form the thumb portion 108, and the thumb portion 108 may be stitched to a cutout 110 in the front main section 102*a*.

According to certain embodiments, the methods for making glove structures and/or components thereof may include providing means for securing the glove structure 100. Means for securing the glove structure 100 proximate the user's wrist may include a closure system 130. The closure system 130 may include one or more flaps, tabs, straps, ties, etc. Optionally, the closure system 130 may be supplied with hook and loop systems, snap systems, magnetic systems, buckles, zipper-like systems, elastic systems, buttons, etc. Further, means for securing the glove structure 100 may be provided on at least one of the front portion 102 and the back portion 120.

According to some embodiments, at least some portions of flexible member 230 may be stitched to the knuckle support member 210. Stitching may provide a durable and reliable attachment. According to other embodiments, the knuckle support member 210 may be over-molded to the flexible member 230. Other injection molding, compression molding, pour molding, co-molding techniques, etc. may be used, depending upon the specific materials used to form the knuckle support member 210 and the flexible member 230. Optionally, the knuckle support member 210 may be adhesive bonded to the flexible member 230. Additionally, or alternatively, the knuckle support member 210 may be "fuse bonded" to the flexible member 230, especially at the edges of the cutouts 212 and at the perimeter of the knuckle support member 210. Over-molding and/or fuse bonding may be desirably processes as they are typically quicker and less expensive manufacturing techniques than stitching, while providing a flexible seam.

The term "fuse bonded" or "fused," as used herein, means that the parts are bonded to one another by applying heat and pressure, by exposing to high frequency radiation and pressure, by exposing to radio frequency waves and pressure, by exposing to laser radiation and pressure, etc., and without the use of adhesives at least over a majority of the fused bonded portions. If desired, a small amount of adhesive may be used to tack the various parts in place with respect to one another prior to the fuse bonding step. The fuse bonding portions of this procedure may follow the procedure as generally described, for example, in U.S. Published Patent Applications US 2011/0088282 and US 2011/0088285, which applications are entirely incorporated herein by reference.

Materials suitable for over-molding (or other molding techniques, including pour molding, etc.) include thermoplastic elastomers (TPE). For example, TPU, nylon, polyesters, etc. may all provide suitable over-molding materials. Other materials such as rubbers, including for example a liquid silicone rubber (LSR), may also be suitable for the over-molding process. Over-molding with liquid silicone rubber may produce pliable, durable parts.

Similar materials may be suitable for fuse bonding. In order to optimize the fuse bonding process, the material of the flexible member 230 and the material of the knuckle support member 210 may be selected so that these materials readily fuse bond to one another without the need for an adhesive or cement between the layers (although, as noted above, some adhesive or cement may be used to maintain relative positioning of the parts before the fuse bonding step takes place). As some more specific examples, the knuckle support member 210 may be a silicone rubber material. Thicknesses of the knuckle support member 210, particularly when it is formed of a silicone rubber, may range from 0.05 mm to 0.25 mm, and in some examples may be approximately 0.15 mm thick. The flexible member 230 may be formed from a material that will readily fuse bond with the material of the knuckle support member 210. Optionally, the material of flexible member 230 may be coated or impregnated with a silicone rubber or other material compatible with a fuse bonding process.

According to certain embodiments, front portion 102 of the glove structure 100 may be constructed of a natural or synthetic leather material. Front portion 102 may be made from multiple pieces that are joined together or the front portion 102, including the palm covering section 102*a* and the plurality of front finger sections 104 (optionally four front finger sections 104*a* through 104*d*) may be provided as a single piece of leather material. Further, the blank for the glove's front portion 102 may include portions of the thumb portion 108 and/or portions of some or all of the gusset members 140. Back main portion 120*a* of the glove 100 may be cut out from a natural or synthetic leather material and formed from multiple pieces that are joined together or provided as a single piece. Similarly, back finger portions 122 may be cut out from the same natural or synthetic leather material. Cutting may be accomplished in any desired manner as known by person of skill in the art, including using die-cutting techniques, laser cutting techniques, manual cutting techniques, etc.

In certain embodiments, the knuckle support member 210 may be cut out from a desired support material supply, such as a silicone rubber or other flexible elastomeric sheet material. Knuckle support member 210 may be formed from multiple pieces that are joined together or provided as a single unitarily-constructed piece.

Similarly, the flexible member 230 may be cut out from a desired flexible member material supply, such as a LYCRA®, Spandex®, Dri-FIT®, etc. as described herein. Flexible member 230 may be formed from multiple pieces that are joined together or provided as a single unitarily-constructed piece.

In like fashion, gusset members 140 and/or the elongated thumb inset 108*b* may be cut out from a desired flexible member material supply, such as a LYCRA®, Spandex®, Dri-FIT®, etc., as described herein. As described above, gusset members 140 (or the elongated thumb inset 108*b*) may be formed from multiple pieces that are joined together or provided as a single unitarily-constructed piece.

Materials for the other parts, such as the closure system 130, the edge piping 170, and the elastic wrist components 116,126, may be produced or obtained from any desired source, such as cut out from larger pieces of appropriate source materials.

Additional steps may be included in this procedure, additional parts may be included in the glove structure 100, various steps may be combined, certain steps may be omitted, and/or the order of various steps may be changed without departing from this invention.

As described above, glove structures 100 incorporating the knuckle support assembly 200, with its arrangement of the knuckle support member 210 in conjunction with the flexible member 230, provide greater flexibility and comfort in the knuckle region(s), while still providing a good, tight, supporting fit. Other options are possible in gloves in accordance with examples of this invention. For example, the fingers of the glove structure need not include fingertips, i.e., one or more of the user's fingers may extend beyond the ends of the glove's fingers, as may be seen in some bicycle or weightlifting gloves. Further, if desired, alternative constructions may be used to form the front portion, if any, as would be known to persons of skill in the art. As examples, the front main section and the thumb portion may be formed from multiple panels with seams extending into the wrist region of the glove. In such case, the thumb portion may also be joined to the back portion. As another option, closure systems may be provided on the front portion of the glove or on both the front and back portions of the glove. As even other options, padding could be selectively provided in areas of the glove expected to see high pressures.

The various components may have any of the structures, arrangements, and/or orientations described herein (and/or any of the structures, arrangements, and/or orientations described in more detail below). Further, any desired order of steps is possible without departing from the invention.

CONCLUSION

The present invention is disclosed above and in the accompanymg drawings with reference to a variety of embodiments. The purpose served by the disclosure, however, is to provide examples of the various features and concepts related to the invention, not to limit the scope of the invention. One skilled in the relevant art will recognize that numerous variations and modifications may be made to the embodiments described herein without departing from the scope of the present invention, as defined by the appended claims.

What is claimed is:

1. A glove structure comprising:

a front portion including a front main section configured to cover a when worn;

a back portion engaged with the front portion and configured to cover when worn wherein the back portion includes:

a back main section configured to extend over at least a portion of a back metacarpal region of the hand, wherein the back main section is formed from a first material; and a separate knuckle support assembly configured to extend over at least a portion of metacarpophalangeal joints of the hand, the knuckle support assembly attached to the back main section, wherein the knuckle support assembly includes a knuckle support member formed from a second material and a flexible member formed from a third material, wherein the knuckle support member includes at least one knuckle cutout comprising an opening configured to be coincident with at least one metacarpophalangeal joint, wherein the flexible member extends across the at least one knuckle cutout, wherein the knuckle support member is molded to the flexible member, and the second material of the knuckle support member has a greater flexural stiffness than the back main section, and wherein the third material of the flexible member has a greater elastic stretchability than the second material of the knuckle support member.

2. The glove structure according to claim 1, wherein the second material of the knuckle support member has a greater elastic stretchability than the first material of the back main section.

3. The glove structure according to claim 1, wherein the third material of the flexible member has a greater elastic stretchability than the first material of the back main section.

4. The glove structure according to claim 1, wherein the back main section includes a natural leather or synthetic leather material, wherein the knuckle support member includes a silicone rubber material, and wherein the flexible member includes elastane fibers.

5. The glove structure according to claim 1, wherein the third material of the flexible member has greater shape retention characteristics than the first material of the back main section.

6. The glove structure according to claim 1, wherein the knuckle support member is configured to extend over at least one proximal interphalangeal joint.

7. The glove structure according to claim 1, wherein the at least one knuckle cutout is configured to be coincident with an index finger.

8. The glove structure according to claim 1, wherein the at least one knuckle cutout includes a cutout configured to be coincident with an index finger, a cutout configured to be coincident with a middle finger, a cutout configured to be coincident with a ring finger, and a cutout configured to be coincident with a little finger.

9. The glove structure according to claim 1, wherein the at least one knuckle cutout further comprises at least one cutout configured to be coincident with at least one proximal interphalangeal joint.

10. The glove structure according to claim 1, wherein the knuckle support assembly includes a proximal perimeter edge having a wave-like configuration, and wherein the knuckle support assembly is attached to the back main section with an undulating engagement line.

11. The glove structure according to claim 1, wherein the knuckle support member forms a continuous path from a first side edge of the back main section to an opposite second side edge of the back main section.

12. The glove structure according to claim 1, wherein the at least one knuckle cutout has a longitudinal dimension and a transverse dimension and wherein the longitudinal dimension is greater than the transverse dimension, wherein the longitudinal dimension is oriented in a proximal-to-distal direction, and the transverse dimension is oriented in a side-to-side direction across a width of the glove structure.

13. The glove structure according to claim 1, wherein the at least one knuckle cutout has a diamond shape.

14. The glove structure according to claim 1, wherein the knuckle support member is configured to be positioned adjacent to a finger valley area formed between an index finger and a middle finger, and wherein the flexible member is configured to be positioned adjacent to a finger valley area formed between a little finger and ring finger and the knuckle support member is configured to be positioned a distance apart from the finger valley area.

15. The glove structure according to claim 1, further comprising: a closure system including a flap having at least a first component of a fastening system and a free end tab extending beyond the first component of the fastening system, and wherein the free end tab includes at least one protrusion for facilitating a user's grip.

16. A glove structure comprising:

a front portion including a front main section configured to cover a palm of a hand when worn;

a back portion engaged with the front portion and configured to cover when worn, wherein the back portion includes:

a back main section configured to extend over at least a portion of a back metacarpal region of the hand, wherein the back main section is formed from a first material;

a separate knuckle support assembly configured to extend over at least a portion of metacarpophalangeal joints of the hand, the knuckle support assembly attached to the back main section, wherein the knuckle support assembly includes a knuckle support member formed from a second material and a flexible member formed from a third material, wherein the knuckle support member includes at least one knuckle cutout comprising an opening configured to be coincident with at least one metacarpophalangeal joint and including a flexible member extending across the at least one knuckle cutout, wherein the flexible member is a continuous layer extending under the knuckle support member, wherein the knuckle support member is molded to the flexible member, and the second material of the knuckle support member has a greater flexural stiffness than the back main section, and wherein the third material of the flexible member has a greater elastic stretchability than the second material of the knuckle support member.

17. A glove structure, comprising:

a front portion including a front main section configured to cover a palm of a hand when worn;

a back portion engaged with the front portion and configured to cover when worn, wherein the back portion includes:

a back main section located opposite the front main section and having a proximal edge and a distal edge, wherein the back main section is formed from a first material and is configured to extend transversely across the back portion from a first side edge of the back portion to an opposite second side edge and is configured to cover at least a portion of a back metacarpal region of the hand;

a separate knuckle support assembly having a proximal edge extending transversely across a part of the back portion attached to the distal edge of the back main section; and a plurality of back finger sections, each back finger section having a proximal edge attached to a distal edge of the knuckle support assembly and a distal edge, wherein the knuckle support assembly includes a knuckle support member formed from a second material and a flexible member formed from a third material;

wherein the knuckle support member includes at least one knuckle cutout comprising an opening configured to be coincident with at least one metacarpophalangeal joint of the hand and including a flexible member extending across the at least one knuckle cutout, wherein the knuckle support member is molded to the flexible member, and the second material of the knuckle support member has a greater flexural stiffness than the back main section, and wherein the third material of the flexible member has a greater elastic stretchability than the second material of the knuckle support member.

* * * * *